US006530566B1

(12) United States Patent
DuVernay

(10) Patent No.: US 6,530,566 B1
(45) Date of Patent: Mar. 11, 2003

(54) PIVOTING CLAMP BLOCK

(75) Inventor: Michael J. DuVernay, Algonac, MI (US)

(73) Assignee: Auto Craft Tool & Die Co., Inc., Algonac, MI (US)

( * ) Notice: Subject to any disclaimer, the term of this patent is extended or adjusted under 35 U.S.C. 154(b) by 0 days.

(21) Appl. No.: 10/126,740

(22) Filed: Apr. 19, 2002

Related U.S. Application Data

(60) Provisional application No. 60/351,267, filed on Jan. 23, 2002.

(51) Int. Cl.[7] ..... B25B 1/14

(52) U.S. Cl. ..... 269/228; 269/201; 269/254 CS

(58) Field of Search ..... 269/228, 201, 269/94, 32, 229, 188, 216, 254 CS; 81/363; 24/71 T, 494, 68 T

(56) References Cited

U.S. PATENT DOCUMENTS

| | | | | | |
|---|---|---|---|---|---|
| 460,883 | A | * | 10/1891 | Nugent | 269/228 |
| 515,545 | A | * | 2/1894 | Plowers | 269/228 |
| 1,018,380 | A | * | 2/1912 | Smith | 269/228 |
| 2,638,805 | A | * | 5/1953 | Bigelow | 269/228 |
| 2,792,866 | A | | 5/1957 | Leal | |
| 3,346,929 | A | * | 10/1967 | Webb | 269/228 |
| 4,043,547 | A | | 8/1977 | Glomb et al. | |
| 4,131,970 | A | | 1/1979 | LeVan | |
| 4,239,274 | A | | 12/1980 | Linberg et al. | |
| 4,572,382 | A | | 2/1986 | Niederprum | |
| 5,253,498 | A | | 10/1993 | Benedict | |
| 5,603,419 | A | | 2/1997 | Peterson | |
| 5,621,955 | A | | 4/1997 | Schmid et al. | |

* cited by examiner

*Primary Examiner*—Lee Wilson
(74) *Attorney, Agent, or Firm*—Dykema Gossett PLLC

(57) ABSTRACT

A clamping fixture is provided that includes a base, a handle pivotally connected to the base and a first jaw lever. The first jaw lever has a pivot end and a jaw end. The first jaw lever has a spacer connected thereto. A second jaw lever is provided having a pivot end and a jaw end. The second jaw lever has a spacer connected thereto. The first and second jaw spacers are pivotally connected to each other and are pivotally connected with respect to a base. A first pivot link is pivotally connected to the first jaw lever. A second pivot link is pivotally connected to the second jaw lever and with the first pivot link. The handle is provided wherein the handle is pivotally connected with respect to the two pivot links and pivotal movement of the handle opens and closes the jaw ends of the jaw lever.

22 Claims, 4 Drawing Sheets

PIVOTING CLAMP BLOCK

This application claims the benefit of U.S. Provisional Application Ser. No. 60/351,267 filed Jan. 23, 2002 entitled PIVOTING CLAMP BLOCK.

FIELD OF THE INVENTION

The field of the present invention is clamping fixtures and in particular, clamping fixtures useful in automotive assembly operations.

BACKGROUND OF THE INVENTION

Clamping fixtures are often utilized to position workpieces in preselected positions during the fabrication and assembly operation. There are several factors to consider when designing a clamping fixture. One such factor is the shape and size of the workpiece to be held. A second is the desired angular orientation of the workpiece to be held. A third is the clamping force desired on the workpiece.

Typically when a clamping fixture may be utilized on different sized or shaped workpieces or on workpieces to be held at different positions, a custom clamping fixture must be designed. A change in clamping force desired can also mandate that a new clamping fixture be developed.

It is apparent to those skilled in the art that if the clamping fixture must be customized for each particular workpiece the expense associated with holding various workpieces is escalated. It is desirable to provide a clamping fixture that can hold various thickness workpieces at a range of angular positions while at the same time provide predictable clamping force regardless of workpiece thickness.

SUMMARY OF THE INVENTION

To make manifest the above delineated and other manifold desires a revelation of the present invention is brought forth. In preferred embodiment the present invention provides a clamping fixture which includes a parallel-spaced multiple member base. Pivotally connected to the base is a handle. The clamping fixture also has first and second jaw levers.

The jaw levers at one extreme end have a compliant gripping surface to engage the workpiece in a non-marring manner. Opposite from the jaw end, the jaw levers have pivot ends. Between the jaw ends and the pivot ends the jaw levers have spacers connected thereto which are pivotally connected to each other to allow the jaw levers to have pivotal movement with respect to one another. At their pivot ends, the jaw levers are each connected to pivot links. The pivot links are pivotally connected to one another. The jaw lever spacers are also pivotally and slidably connected to the base members via a slot in the base members.

The above-noted arrangement allows the clamping fixture to angularly position itself with respect to workpieces of different orientations. The handle is pivotally connected to the base at approximately its mid point and is pivotally and slidably connected to one of the pivot links connected with the jaw lever. One of the spacers is slidably connected to its respective jaw lever and is spring biased away from the other jaw lever by Belleville washers which are captured on the back side of the jaw lever.

After a workpiece has been presented between the jaw end of the jaw lever, the handle is pivoted upwards causing the pivot links to assume a generally straight position and thereby compress the workpiece. Further upward movement of the handle causes the handle to have an over-center toggle effect, retaining the workpiece within the fixture. To release the fixture, the movement of the handle is reversed.

It is a feature of the present invention to provide a fixture which can retain various workpieces of various thickness at various angles.

DETAILED DESCRIPTION OF THE DRAWINGS

Figure 1:
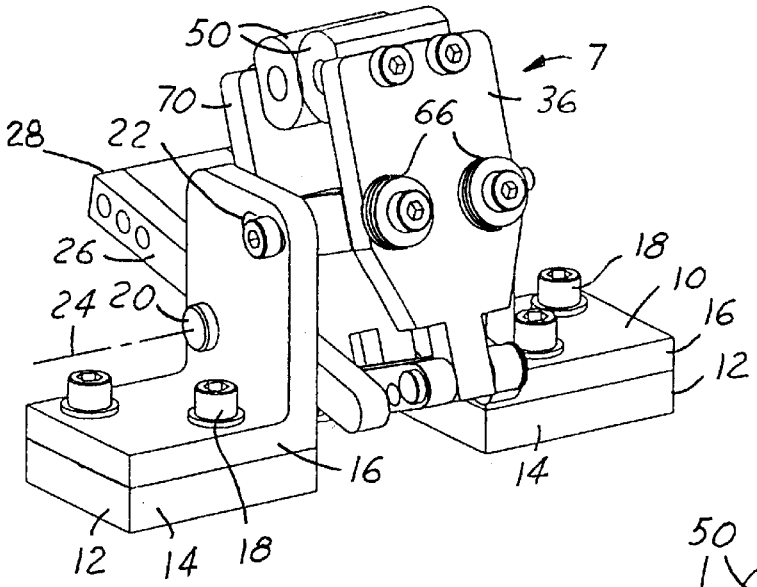
FIGS. 1 and 2 are perspective views of a preferred embodiment clamping fixture of the present invention.

Referring to FIGS. 1–9 and 17, a clamping fixture 7 of the present invention has a base 10. The base includes two parallel-spaced members 12 having a lower base plate 14 and an upper fixably connected angle member 16. The base members 12 are held to a platform or an assembly line carrier by a series of cap screws 18. The base member 12 has an aperture that is shown covered by a head 20 of a pin 21. The pin 21 extends through a corresponding aperture on its opposite parallel-spaced base member.

Figure 9:
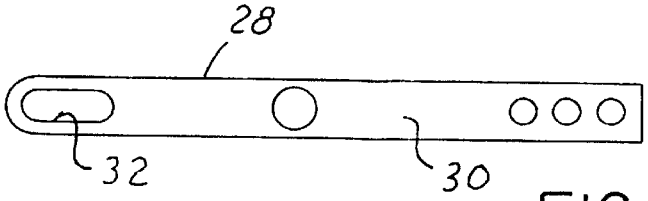
FIG. 9 is a side elevational view of a handle utilized in the clamping fixture shown in FIGS. 1 and 2.

The angle member 16 also has an elongated slot 22. Pivotally connected to the base 10 by the pin 21 along a fixed pivotal axis 24 is a handle 26. The handle 26 includes two rear parallel rail members 28. Each rail member 28 along its inner surface 30 has an elongated slot 32 (FIG. 9). The handle has a spacer pad 33 which is captured between the two rail members. The rail members and base 10 are typically fabricated from steel or other suitable metal materials. The spacer pad may be made of metal or in some instances may be made of a generally rigid polymeric material if so desired.

Figure 10:
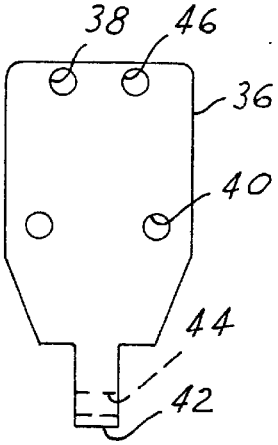
FIG. 10 is a front elevational view of the first jaw lever of the clamping fixture shown in FIGS. 1 and 2.

Referring to FIG. 10, the clamping fixture 7 also has a first jaw lever 36. The first jaw lever 36 is typically fabricated from a metal such as steel or other suitable materials. The first jaw lever 36 has two upper fastener apertures 38. A lower or pivot end 42 of the first jaw lever has a transverse pivot pin aperture 44.

Figure 17:
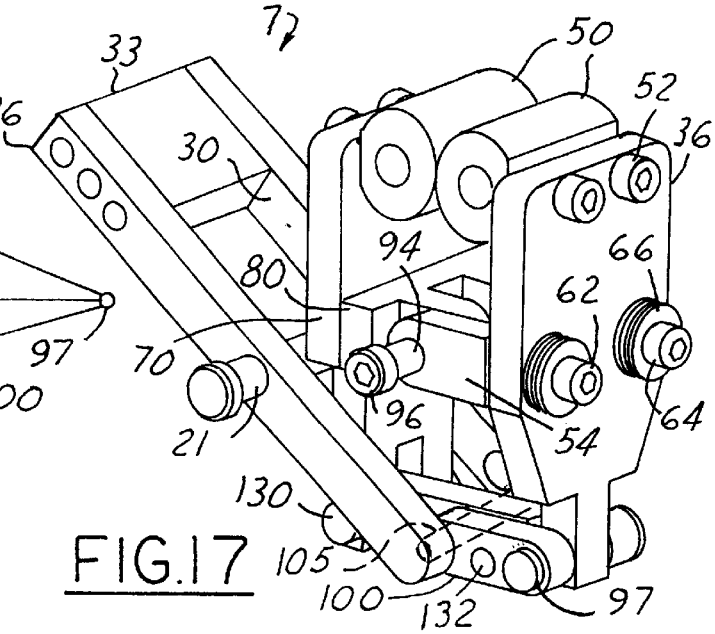
FIG. 17 is a partial perspective view of the clamping fixture shown in FIGS. 1 and 2.

Connected to a top or jaw end 46 of the first jaw lever is a polymeric jaw 50 (FIG. 17.) The jaw 50 will preferably be fabricated from a compliant polymeric material such as duro urethane. The jaw 50 is connected to the first jaw lever by cap screws 52 or other suitable fasteners which extend through the aperture.

Figure 11:
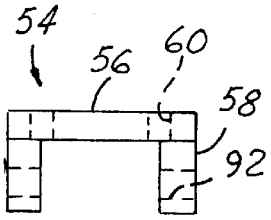
FIG. 11 is a top elevational view of a main body portion of a first spacer used in the clamping fixture shown in FIGS. 1 and 2.

Connected to the first jaw lever 36 between its jaw end 46 and pivot end 42 is a spacer 54. The spacer 54 has a main body 56 (FIG. 11) along with two outer ears 58. The main body 56 has threaded apertures 60 generally aligned with apertures 40 of the first jaw lever 36. Threadably inserted within the main body 56 threaded apertures 60 are cap screws 62. The main body 56 and ears 58 form a first portion of the spacer 54. The cap screws 62 comprise a second portion of the spacer 54. The cap screws 62 have a shank (not shown) which is threadably engaged within the threaded aperture 60. The shanks of cap screws 62 are slidably connected to the first jaw lever 36 within the apertures 40. This arrangement allows the spacer 54 to have sliding movement with respect to the first jaw lever 36. The cap screws 62 have a head 64. Captured between the head 64 and the first jaw lever 36 are a series of Belleville washers 66 which encircle the shanks of the cap screws 62.

Figure 2:
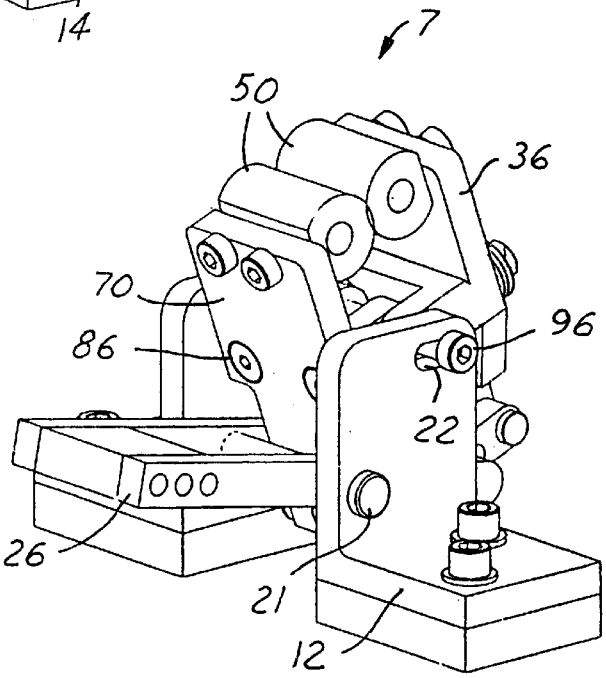
Figure 3:
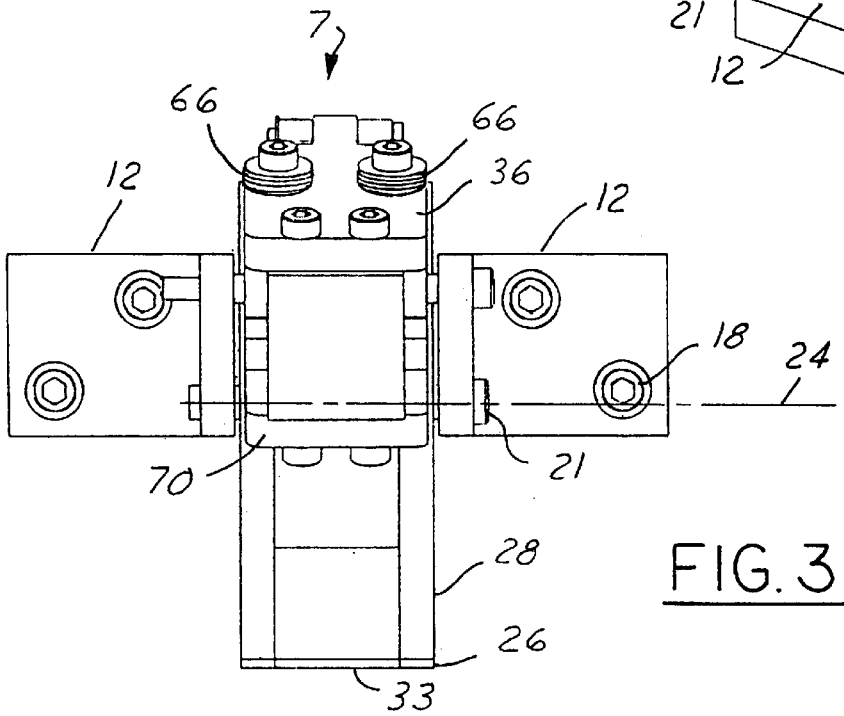
FIG. 3 is a top plane view of the clamping fixture shown in FIGS. 1 and 2.
Figure 4:
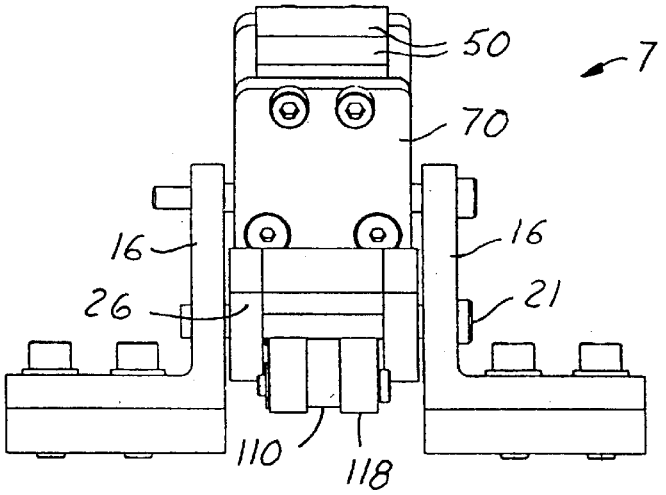
FIG. 4 is a front elevational view of the clamping fixture shown in FIGS. 1 and 2.
Figure 5:
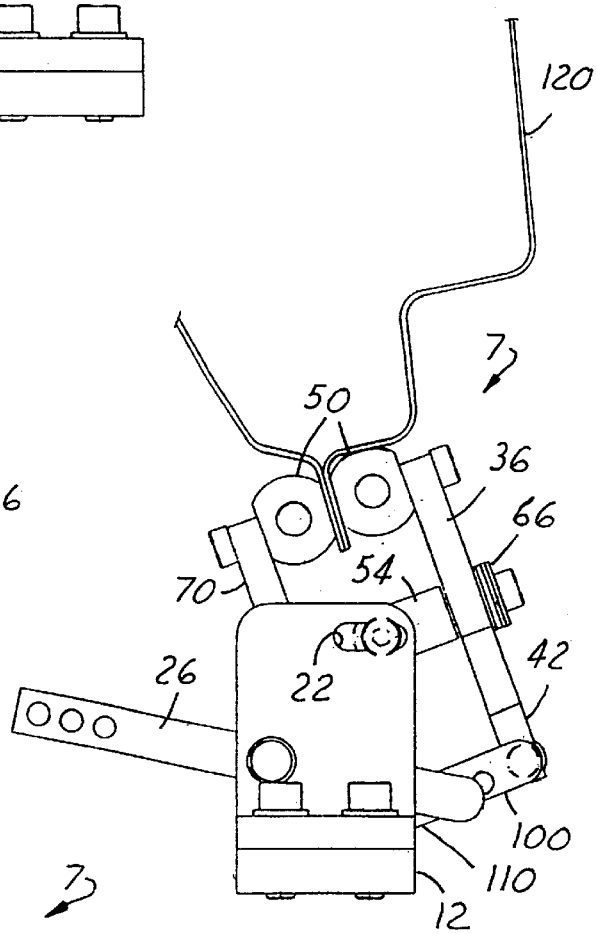
FIGS. 5 and 6 are side elevational views of the clamping fixture shown in FIGS. 1 and 2 clamping different door workpieces with different presentation angles.
Figure 12:
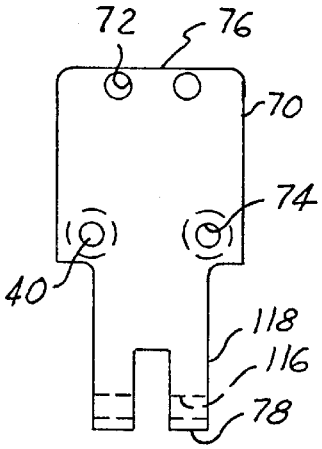
FIG. 12 is a front elevational view of a second jaw lever of the clamping fixture shown in FIGS. 1 and 2.
Figure 13:
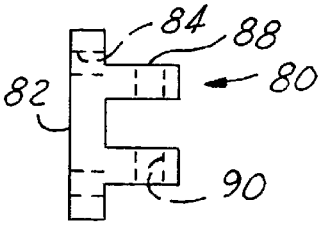
FIG. 13 is a top plane view of the second spacer utilized in the clamping fixture shown in FIGS. 1 and 2.
Figure 14:
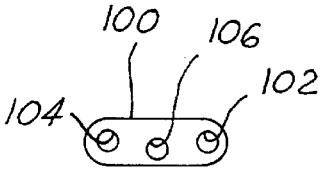
FIG. 14 is a side elevational view of a first pivot link utilized in the clamping fixture shown in FIGS. 1 and 2.
Figure 15:
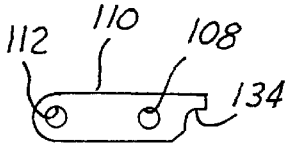
FIG. 15 is a side elevational view of a second pivot link utilized in the clamping fixture shown in FIGS. 1 and 2.

Referring additionally to FIG. 12, the clamping fixture 7 also has a second jaw lever 70. The second jaw lever 70 has apertures 72 which allow for penetration of cap screws 52 which provide for connection of jaw 50 in the manner essentially similar or identical as previously described for the connection of a jaw to the first jaw lever 36. Additionally, the second jaw lever 70 has apertures 74. Connected to the second jaw lever 70 between a second jaw lever jaw end 76 and a pivot end 78 is a second spacer 80 (FIG. 13). The second spacer 80 has a main body 82. The main body 82 has two threaded bores 84 aligned with the apertures 74 of the second jaw lever 70. The threaded bores 84 receive the shanks of cap screws 86 (FIG. 2).

The second spacer 80 also has projecting from the main body two parallel spaced ears 88. The ears 88 are received between a spacing of the ears 58 of the first jaw member 36. The ears 88 have a transverse bore 90 which is aligned with a transverse bore 92 provided in the ears 58. Inserted through the transverse bores 90, 92 is a pivot pin 94. The pivot pin 94 allows the first and second spacers 54, 80 to not only pivot with one another but to have a common pivotal axis with respect to the base 10. The pivot pin 94 has a cap 96 (FIGS. 2, 17) to entrap it within the slots 22 provided in the base member 12.

Referring additionally to FIGS. 14–17, a pair of first pivot links 100 with apertures 102 is provided. The first pivot links 100 are connected with the pivot end 42 of the first jaw lever by a pivot pin 97, which extends through apertures 102 and 44. The first pivot links 100 have an aperture 104 on their opposite end similar to aperture 102. Between apertures 102 and 104 is an aperture 106, which has a center slightly off or lower than the center of the apertures 102 and 104. A pivot pin 105 extends through apertures 104 of the first pivot links 100 and extends through apertures 108 of second pivot links 110, thereby pivotally connecting the pivot links 100, 110 together. The end of pivot pin 105 is captured in the slot 32 of the handle rail member 28. The aperture 112 is penetrated by a pivot pin 130 which projects through transverse aperture 116 of ears 118 of the second jaw lever 70 to pivotally connect the second jaw lever 70 with the second pivot link 110 (FIG. 17).

Referring additionally to FIGS. 5–8 and 16, in operation, a workpiece 120 which is a door module is presented to the clamping fixture 7. The door module 120 has an inner body 122 which is joined to an outer body 124 to form a flange 126. Typically the clamping fixture 7 would be connected with a carrier which proceeds through the assembly plant. Two parallel positioned clamping fixtures 7 will be utilized to hold the door at its lower end by its flange 126. Similar clamping fixtures (not shown) may be used to hold the door module 120 at its upper end and sides. The pivotal connection of the first and second jaw levers 36 and 70 by the pivotal connection of pivot pin 94 in the base slot 22 allows the clamping fixture 7 to angularly adjust to the desired presentation position of the flange 126.

After insertion of the flange 126 into the jaws 50 the jaws 50 will be slightly compressed and the first jaw lever 36 will be pivoted rearwardly against the biasing force provided by the Belleville washers 66. Before insertion of the flange 126 within the jaws 50, the pin 105 which extends through the first pivot link apertures 104 and the second pivot link aperture 108 will be slightly elevated as compared with a line connecting the pins 97, 130 (FIG. 17).

Figure 16:
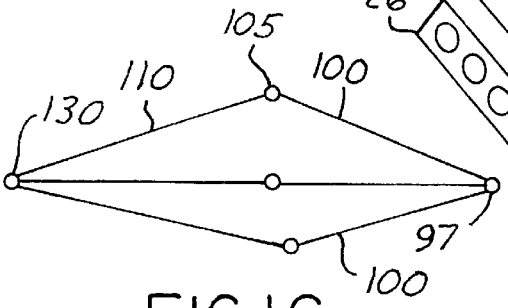
FIG. 16 is a schematic view of the positions of the first and second pivot links with certain angles being exaggerated for purposes of illustration.

Pivotal movement of the handle 26 in a clockwise direction (as shown in FIG. 1) causes the pin 130 with ends entrapped within the slot 32 to be pushed downward thereby extending the overall length provided by the combination of the first and second pivot links 100 and 110 (FIG. 16). This movement causes the pivot ends 42 and 78 of the jaw levers to extend away from each other to further compress the door module 120 within the jaws 50. Continued upward pivotal movement of the handle 26 causes the pivot links 100 and 110 to form a slight lower "V" (FIG. 16) configuration giving the clamping fixture 7 an over center toggle effect.

The first pivot links 100 are connected by a pin 132 which extends between them. The second pivot link has a finger 134 that makes contact with the pin 132 which provides a stop for the first pivot links to limit the angular orientation of the first pivot links 100 with respect to the second pivot link 110. This stop also limits the clamping force which can be applied to the door module 120 to an amount which is set by the Belleville washers 66.

To release the workpiece from the fixture, the handle 26 is rotated downward as shown in the drawings in a counter clockwise direction wherein the workpiece is released and the links 100, 110 will again have a slightly modified inverted "V" (FIG. 16) orientation with one another.

The amount of clamping force which is provided by the clamping fixture can be adjusted by a change in the spring constant or the number of the Belleville washers which are utilized. The advantage to the present invention is that the Belleville washers provide a generally constant clamping force to workpiece thickness varying between three to five millimeters. Therefore, a new clamping fixture is not needed for similar workpieces as long as the thickness variation is within acceptable limits.

Figure 6:
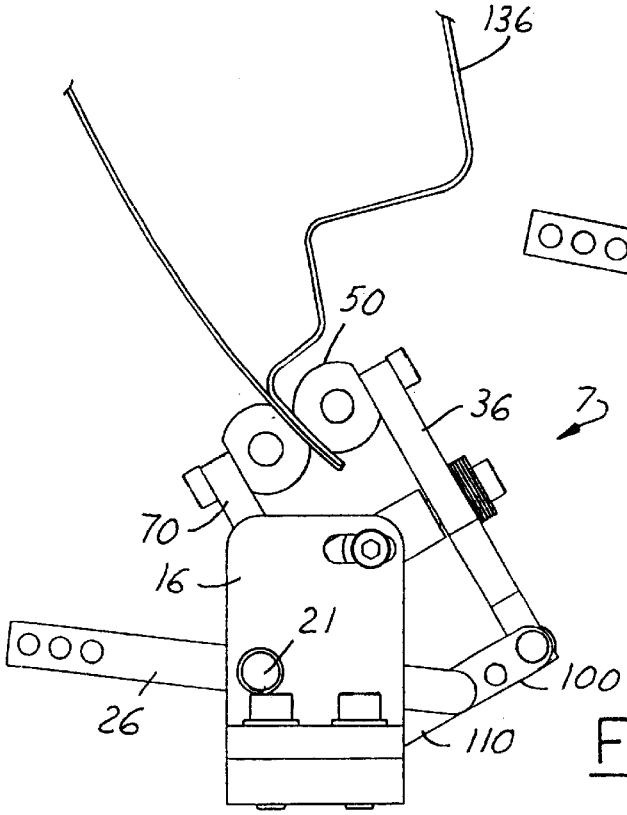
Figure 8:
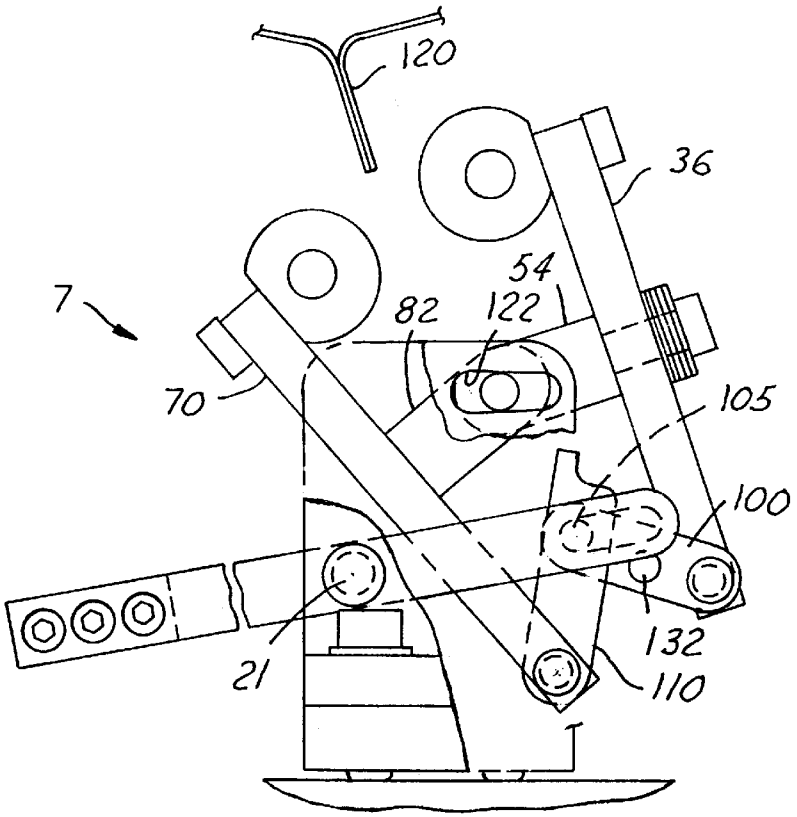
FIGS. 7 and 8 are operational views of the clamping fixture shown in FIGS. 1 and 2.
Figure 7:
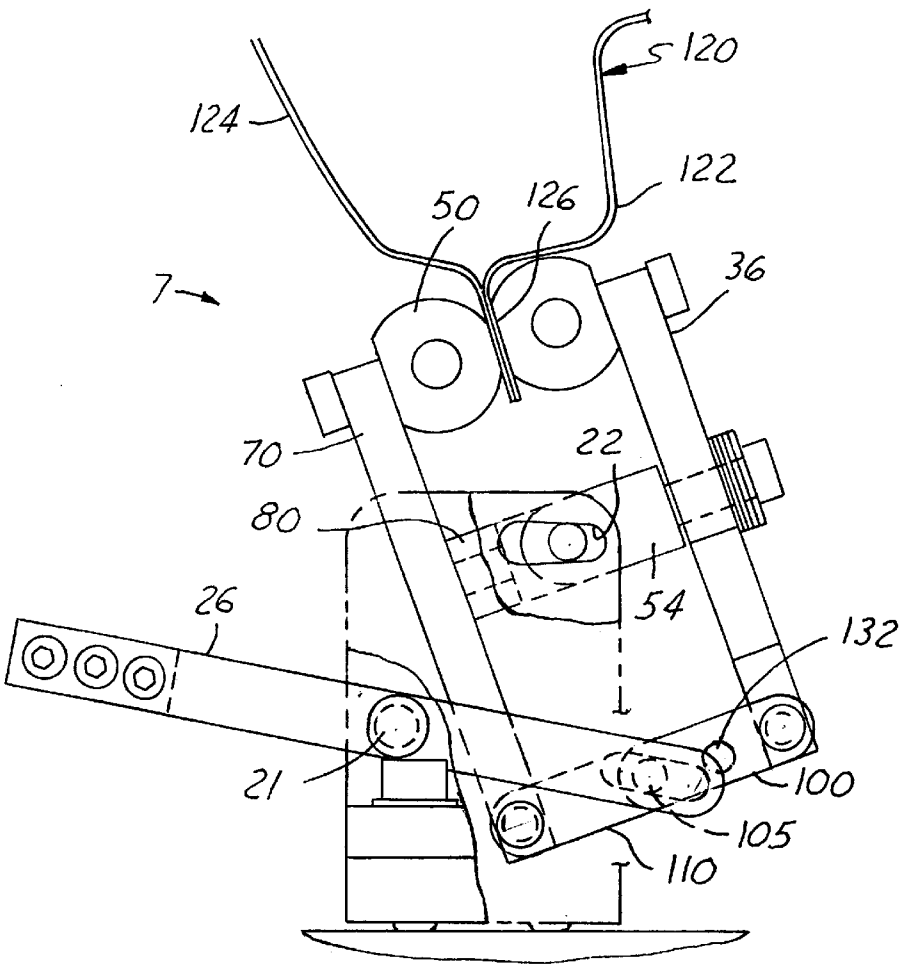

FIG. 6 shows another feature of the present invention. Because the spacers 54, 80 can rotate with respect to the base member 12, the clamping fixture 7 can be utilized for different workpieces such as workpiece 136 even though that workpiece is presented at a different clamping angle.

The present invention has been shown in a preferred embodiment, however, it is apparent to those skilled in the art that various changes and modifications can be made without departing from the spirit and scope of the invention as it is described in the accompanying claims.

I claim:

1. A clamping fixture comprising:

a base;

a handle pivotally connected with respect to said base;

a first jaw lever having a pivot end and a jaw end, said first jaw lever having a spacer connected thereto;

second jaw lever having a pivot end and a jaw end, said second jaw lever having a spacer connected thereto and wherein said first and second jaw spacers are pivotally connected to each other and pivotally connected with respect to said base;

a first pivot link pivotally connected with said first jaw lever;

a second pivot link pivotally connected with said second jaw lever and with said first pivot link; and wherein said handle is pivotally connected with respect to said pivot links and wherein pivotal movement of said handle opens and closes said jaw ends of said jaw levers.

2. The clamping fixture as described in claim 1, further including a spring biasing together said jaw ends of said first and second jaw levers.

3. The clamping fixture as described in claim 1, wherein said handle and said pivot links cooperate to function as an over center toggle effect for a clamping output by said jaw levers.

4. The clamping fixture as described in claim 1 wherein said handle has a fixed pivotal axis with respect to said base and said handle has sliding as well as pivotal movement with respect to said pivot links.

5. The clamping fixture as described in claim 1, wherein said first and second spacers are also slidable with respect to said base.

6. The clamping fixture as described in claim 1, wherein said spacer on one of said jaw levers can slidably move with respect thereto and said spacer is spring biased away from other said jaw lever.

7. The clamping fixture as defined in claim 6, wherein said spacer is slidably connected with said first jaw lever.

8. The clamping fixture as defined in claim 6, wherein said spring is a belleville washer.

9. The clamping fixture as described in claim 1, wherein said base includes first and second members parallel spaced from one another and wherein said handle is pivotally connected with respect to said base between said first and second members.

10. The clamping fixture as defined in claim 1, wherein said first and second spacers are pivotally connected to each other and with respect to said base along a common pivotal axis.

11. The clamping fixture as described in claim 1, wherein at least one jaw end of said jaw levers is compliant.

12. The clamping fixture as described in claim 11, wherein said jaw end of said jaw lever is formed from a polymeric material.

13. The clamping fixture as described in claim 1, wherein said handle is pivoted upwards to retain said clamping fixture jaw levers about a workpiece and said handle is pushed downward to release said clamping fixture jaw levers from a workpiece.

14. The clamping fixture as described in claim 1, wherein one of said pivot links has a stop portion for making contact with said other pivot link to limit the pivotal movement of said first pivot link with respect to said second pivot link.

15. A clamping fixture comprising:

a base having first and second parallel spaced members;

a handle pivotally connected with said base first and second members about a fixed pivotal axis;

a first jaw lever having a pivot end and a jaw end;

a first spacer having a first portion extending in a first direction away from said first jaw lever and a second portion extending through apertures in said first jaw lever and being slidably connected thereto, said first spacer being spring biased towards said first jaw lever by a belleville washer spring encircling said second portion and captured between said first jaw lever and said first portion;

a second jaw lever having a jaw end and a pivot end;

a second spacer fixably connected to said second jaw lever extending toward said first jaw lever, said second spacer being pivotally connected to said first spacer and being pivotally and slidably connected to said base members;

a first pivot link pivotally connected with said first jaw lever adjacent said first jaw lever pivot end;

a second pivot link pivotally connected with said second jaw lever adjacent said second jaw lever pivot end and also being pivotally connected with said first jaw lever; and wherein said handle is pivotally and slidably connected with said first pivot link wherein pivotal movement upwards of said handle causes said clamping fixture to retain a workpiece between said jaw ends of said first and second jaw levers and pivotal movement of said handle in an opposite direction causes said jaw ends of said first and second jaw levers to release said workpiece.

16. The clamping fixture as described in claim 15, wherein said jaw ends of said first and second jaw levers are pliable.

17. The clamping fixture as described in claim 15, wherein spring biasing force exerted by said belleville washer is adjustable by replacement of said belleville washer.

18. The clamping fixture as described in claim 15, wherein one of said pivot links has a member to make contact with said other pivot link to limit an angular orientation of said pivot links with respect to one another.

19. The clamping fixture as described in claim 15, wherein spring biasing force exerted by said belleville washer is adjustable by adding a belleville washer.

20. A clamping fixture comprising:

a base;

a handle pivotally connected with respect to said base;

a first jaw lever having a pivot end and a jaw end, said first jaw lever having a spacer connected thereto;

a second jaw lever having a pivot end and a jaw end, said second jaw lever having a spacer connected thereto and wherein said first and second jaw spacers are pivotally connected to each other and pivotally connected with respect to said base along a common pivotal axis;

a first pivot link pivotally connected with said first jaw lever;

a second pivot link pivotally connected with said second jaw lever and with said first pivot link;

wherein said handle is pivotally connected with respect to said pivot links; and wherein pivotal movement of said handle opens and closes said jaw ends of said jaw levers.

21. A clamping fixture comprising:

a base;

a handle pivotally connected with respect to said base;

a first jaw lever having a pivot end and a jaw end, said first jaw lever having a spacer connected thereto;

a second jaw lever having a pivot end and a jaw end, said second jaw lever having a spacer connected thereto and wherein said first and second jaw spacers are pivotally connected to each other and pivotally connected with respect to said base along a common pivotal axis;

a first pivot link pivotally connected with said first jaw lever;

a second pivot link pivotally connected with said second jaw lever and with said first pivot link;

wherein said handle is pivotally connected with respect to said pivot links;

wherein pivotal movement of said handle opens and closes said jaw ends of said jaw levers; and wherein said handle is pivoted upwards to retain said clamping jaw levers about a workpiece and said handle is pushed downward to release said clamping fixture from a workpiece.

22. A clamping fixture comprising:

a base;

a handle pivotally connected with respect to said base;

a first jaw lever having a pivot end and a jaw end, said first jaw lever having a spacer connected thereto;

a second jaw lever having a pivot end and a jaw end, said second jaw lever having a spacer connected thereto; and wherein said first and second jaw spacers are pivotally connected to each other and pivotally connected with respect to said base along a common pivotal axis;

a first pivot link pivotally connected with said first jaw lever;

a second pivot link pivotally connected with said second jaw lever and with said first pivot link;

wherein said handle is pivotally connected with respect to said pivot links and wherein pivotal movement of said handle opens and closes said jaw ends of said jaw levers; and wherein a spacer on one of said jaw levers can slidably move with respect to said jaw lever said spacer is attached to and a spacer biased away from said other jaw lever.

* * * * *

UNITED STATES PATENT AND TRADEMARK OFFICE

CERTIFICATE OF CORRECTION

PATENT NO. : 6,530,566 B1
DATED : March 11, 2003
INVENTOR(S) : DuVernay

It is certified that error appears in the above-identified patent and that said Letters Patent is hereby corrected as shown below:

Column 8,
Line 22, after the word "and" please delete "a" and insert -- said --.
Line 22, after the word "spacer" please insert -- is --.

Signed and Sealed this

Twenty-second Day of July, 2003

JAMES E. ROGAN
*Director of the United States Patent and Trademark Office*